US006356169B1

(12) United States Patent
Toda et al.

(10) Patent No.: US 6,356,169 B1
(45) Date of Patent: Mar. 12, 2002

(54) BAND PASS FILTER, ANTENNA DUPLEXER, AND COMMUNICATION APPARATUS

(75) Inventors: Jun Toda; Motoharu Hiroshima; Hideyuki Kato, all of Ishikawa-ken (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/452,984

(22) Filed: Dec. 2, 1999

(30) Foreign Application Priority Data

Dec. 3, 1998 (JP) ..... 10-343987

(51) Int. Cl.[7] ..... H01P 1/20; H01P 5/12
(52) U.S. Cl. ..... 333/206; 333/202; 333/134
(58) Field of Search ..... 333/202, 206, 333/134, 207

(56) References Cited

U.S. PATENT DOCUMENTS

| | | | | | |
|---|---|---|---|---|---|
| RE34,898 | E | * | 4/1995 | Turunen et al. | 333/206 |
| 5,612,654 | A | * | 3/1997 | Tsujiguchi et al. | 333/202 |
| 6,002,309 | A | * | 12/1999 | Nishijima et al. | 333/206 |
| 6,087,909 | A | * | 7/2000 | Toda et al. | 333/134 |
| 6,150,905 | A | * | 11/2000 | Nishijima | 333/206 |

FOREIGN PATENT DOCUMENTS

| | | | |
|---|---|---|---|
| EP | 0664572 | | 7/1995 |
| EP | 0831544 | | 3/1998 |
| EP | 0840390 | A1 * | 6/1998 |
| EP | 0853349 | | 7/1998 |
| EP | 0863566 | | 9/1998 |
| EP | 0951089 | | 10/1999 |

* cited by examiner

*Primary Examiner*—Robert Pascal
*Assistant Examiner*—Patricia T. Nguyen
(74) *Attorney, Agent, or Firm*—Ostrolenk, Faber, Gerb & Soffen, LLP

(57) ABSTRACT

There is provided a band pass filter comprising three or more resonant-line holes disposed in a dielectric block, a resonant line formed on each inner surface of the holes, and an outer conductor disposed on the outer surfaces of the dielectric block so that a dielectric filter is formed; wherein one end of the resonant line is a short-circuited end, and the other end thereof is an open end; the sectional area size of each of the resonant-line holes is changed at a certain point in the axial direction of the resonant-line hole; the sectional area size on the short-circuited-end side or open-end side of at least one of the plurality of resonant-line holes is made differently from those of the other resonant-line holes; and regarding the resonant-line holes symmetric with respect to a symmetry axis made at the center in a direction in which the plurality of resonant-line holes is aligned, the sectional area sizes of the short-circuited-end side or open-end side thereof are made the same so as to form coupling between adjacent resonant lines.

9 Claims, 4 Drawing Sheets

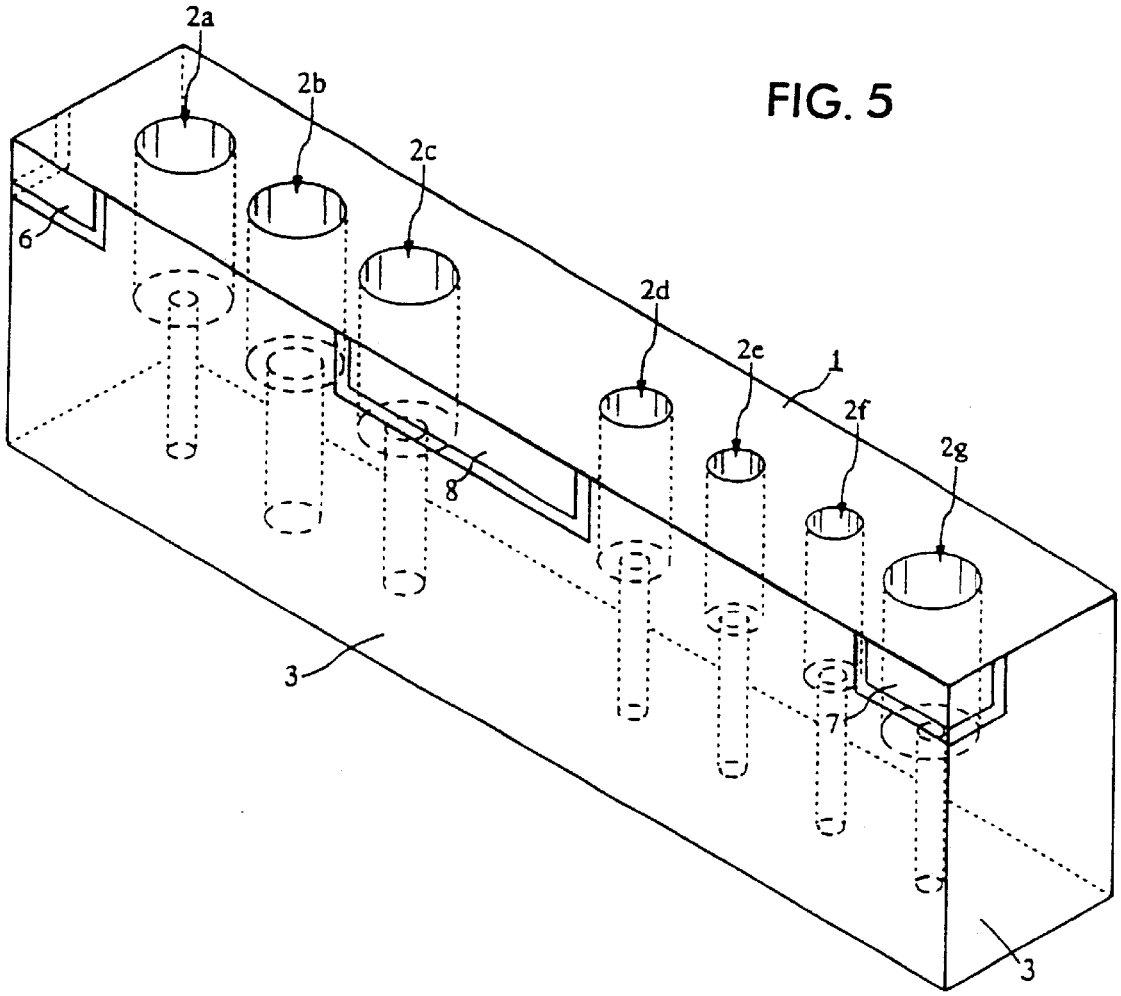
FIG. 5
FIG. 6
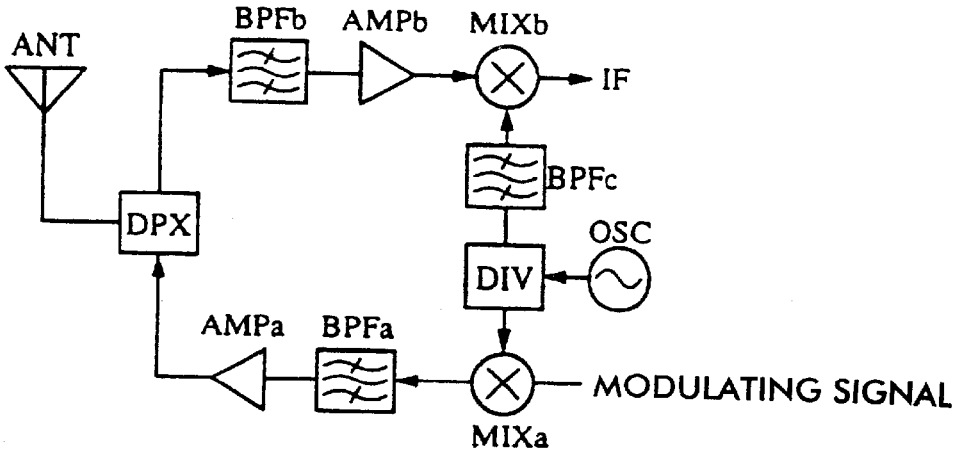

BAND PASS FILTER, ANTENNA DUPLEXER, AND COMMUNICATION APPARATUS

BACKGROUND OF THE INVENTION

1. Field of the Invention

The present invention relates to band pass filters, antenna duplexers used in high-frequency bands, and communication apparatuses incorporating the same.

2. Description of the Related Art

Dielectric filters, in which a plurality of resonant-line holes is aligned in a dielectric block, a resonant line being formed on the inner surface of each of the resonant-line holes, and an outer conductor being formed on the outer surface of the dielectric block, are disclosed in (1) Japanese Unexamined Patent Publication No. 6-310911, (2) Japanese Patent Publication No. (by PCT Application) 6-505608, (3) Japanese Unexamined Patent Publication No. 7-86807, (4) Japanese Unexamined Patent Publication No. 2-92001, and (5) Japanese Unexamined Patent Publication No. 5-37203.

In a dielectric filter described in (1), a hole is disposed passing through between a first end face and a second end face of the dielectric block, which are mutually opposing, a conductive film is formed on the surfaces except the first end face and in the through-hole, in which the first end-face side and the second end-face side of the through-hole have different sectional shapes, by which the characteristic impedance at the open-end side of the resonant line is different from that at the short-circuited-end side thereof to form a coupling between the resonators.

In a dielectric filter described in (2), a through-hole having a fixed sectional shape is formed in a dielectric block, in which a conductor is formed on the outer surfaces except one opening face of the through-hole and on the inner surface thereof, and an input/output terminal (a pad) is disposed on a side surface of the dielectric block.

In a dielectric filter described in (3), a through-hole having a conductive film formed on the inner surface thereof is disposed in a dielectric block, in which the conductive film on the inner surface of the through-hole and the conductive film on the outer surfaces of the dielectric block are electrically connected by one end face of the through-hole, whereas a recessed portion is formed on the other end face thereof, and a conductive film extended from the conductive film formed on the inner surface of the through-hole is formed on the inner surface of the recessed portion to form an additional capacitance at the opening end of the resonant line.

In a dielectric filter described in (4), similar to the case of (1), a hole is disposed passing through between a first end face and a second end face of a dielectric block, which are mutually opposing, and a conductive film is each formed on the surfaces except the first end face and in the through-hole, in which a step is arranged for dividing a large-diameter part and a small-diameter part of the through-hole, and adjacent resonant lines have differences in the inner-diameter ratios between the large-diameter parts and small-diameter parts thereof or in the axial-direction lengths of the small-diameter parts thereof.

In a dielectric filter described in (5), a through-hole and a groove whose bottom is an end face of the through-hole are formed in a dielectric block, in which a part of the dielectric block is cut off to widen the groove, and the conductor on the inner surface of the through-hole is extended to the conductor on the inner-side surface of the groove to produce a capacitance between the inner conductor and the outer conductor.

In each of the conventional dielectric filters disclosed in (1) to (3), the detailed structure of the through-hole passing through from the open face of the dielectric block to the short-circuited face thereof and the advantages obtained by the structure are not described. In the dielectric filter described in (4), in order to adjust the resonant frequencies of resonators so as to obtain a specified frequency balance, the inner-diameter ratio between the large-diameter part and small-diameter part of the resonant-line hole of each resonator or the axial-direction length of the small-diameter part thereof is changed with respect to an adjacent resonator (a resonant line) to relatively change the characteristic impedance of the open-face side part of the resonant line with respect to that of the short-circuited-face side part thereof so as to set a coupling coefficient between the adjacent resonant lines. In addition, in the dielectric filter described in (5), the part where a portion is cut off does not operate as a resonator and forms an additional capacitance.

In such conventional dielectric filters, it is difficult to make a coupling between specified adjacent resonant lines of the aligned plural resonant lines independently different from the coupling between the other resonant lines. Thus, there is a problem in that it is difficult to design a specified band-pass characteristic and attenuation-pole frequency. In order to obtain a specified filter characteristic, it is possible to use a method in which the pitch of the aligned resonant-line holes and positions (a stepped position) where the inner-diameters of the resonant-line holes are changed are each appropriately set. However, as a result, the size of the outline of the dielectric block is increased, which leads to an increase in the size of the overall dielectric block. Furthermore, when the sizes of the large-diameter part and small-diameter part of each of the resonant-line holes and the stepped positions of the resonant-line holes are not fixed, manufacturing efficiency is reduced.

SUMMARY OF THE INVENTION

To overcome the above described problems, preferred embodiments of the present invention provide a band pass filter, an antenna duplexer, and a communication apparatus incorporating the same, in which three or more resonant-line holes are aligned in a single dielectric block to easily obtain a desired filter characteristic and to achieve easy manufacturing.

One preferred embodiment of the present invention provides a band pass filter including three or more resonant-line holes disposed in a dielectric block, a resonant line formed on each inner surface of the holes, and an outer conductor formed on the outer surfaces of the dielectric block so that a dielectric filter is formed, wherein an end of the resonant line is a short-circuited end, and the other end thereof is an open end; the sectional area size of each of the resonant-line holes is changed at a certain point in the axial direction of the resonant-line hole; the sectional area size on the short-circuited-end side or open-end side of at least one of the plurality of resonant-line holes is made differently from those of the other resonant-line holes; and regarding the resonant-line holes symmetric with respect to a symmetry axis made at the center in a direction in which the plurality of resonant-line holes is aligned, the sectional area sizes of the short-circuited-end side or open-end side thereof are made the same so as to form coupling between adjacent resonant lines.

Another preferred embodiment of the present invention provides a band pass filter including three or more resonant-line holes disposed in a dielectric block, a resonant line formed on each inner surface of the holes and an outer conductor formed on the outer surfaces of the dielectric block to constitute a dielectric filter, wherein one end of the resonant line is a short-circuited end, and the other end thereof is an open end; the sectional area size of each of the resonant-line holes is changed at a certain point in the axial direction of the resonant-line hole; the distances between the short-circuited-end sides or open-end sides of the adjacent resonant-line holes are made asymmetrically with respect to an axis at the center in a direction in which the plurality of resonant-line holes is aligned so as to form coupling between adjacent resonant lines.

With the above described arrangements, the lengths of the resonant lines are fixed, and without changing the stepped positions of the resonant-line holes, a specified coupling between the adjacent resonant lines can independently be determined. Also, band-pass-filter characteristics can easily be obtained.

In the above described band pass filters, the sectional area sizes of the short-circuited-end side or open-end side of the resonant-line holes may be equal for all of the resonant-line holes.

In addition, in the above described band pass filters, the resonant-line holes may have the equally fixed lengths between the short-circuited ends and the points where the sectional area sizes are changed.

With the above described arrangements, when the dielectric block is molded, distribution of the internal stress is made uniform so that deformation and variation can be reduced. Furthermore, the structure of a metal die for molding the dielectric block is simplified and the production of the metal die is thereby easily performed, which leads to reduction in manufacturing cost.

Furthermore, in the above described band pass filters, an opening face of each resonant-line hole may be an open face where no outer conductor is formed and the open face may be used as the open end of the resonant line. With this arrangement, it is not necessary to dispose a coupling electrode on the open face of the dielectric block. Since the open end of each resonant line can be formed only by plane-processing of the open face, manufacturing cost can be reduced.

Furthermore, in the above described band pass filters, an nonconducive portion separated from the outer conductor may be disposed at a place recessed from the opening face of each resonant-line hole to make the nonconducive portion the open end of the resonant line. With this arrangement, since the open end of the resonant line exists inside the resonant-line hole, an electromagnetic leak is strongly reduced. In addition, since a position for disposing the nonconductive portion and the size thereof can be equal for all the resonant-line holes, it is not necessary to change processing conditions, with the result that shortening of the processing time and the reduction in manufacturing cost can be achieved.

Yet another preferred embodiment of the present invention provides an antenna duplexer including the dielectric filter having one of the above-described structures as a transmitting filter and a receiving filter formed in a single dielectric block, a transmitting-signal input terminal for being coupled to the initial-stage resonant line of the transmitting filter, a receiving-signal output terminal for being coupled to the final-stage resonant line of the receiving filter, and an antenna terminal for being coupled to the final-stage resonant line of the transmitting filter and the initial-stage resonant line of the receiving filter, respectively.

According to the above described arrangements, an overall compact antenna duplexer can be obtained.

Yet another preferred embodiment of the present invention provides a communication apparatus including the band pass filter or the antenna duplexer described above, which is disposed in a high-frequency circuit section.

According to the above described arrangements, a more compact communication apparatus can be obtained.

Other features and advantages of the present invention will become apparent from the following description of the invention which refers to the accompanying drawings.

BRIEF DESCRIPTION OF DRAWINGS

FIG. 5 is a view showing the structure of an antenna duplexer according to a fifth embodiment of the present invention.

FIG. 6 is a block diagram showing the structure of a communication apparatus according to a sixth embodiment of the present invention.

DESCRIPTION OF PREFERRED EMBODIMENTS

Figure 1A:
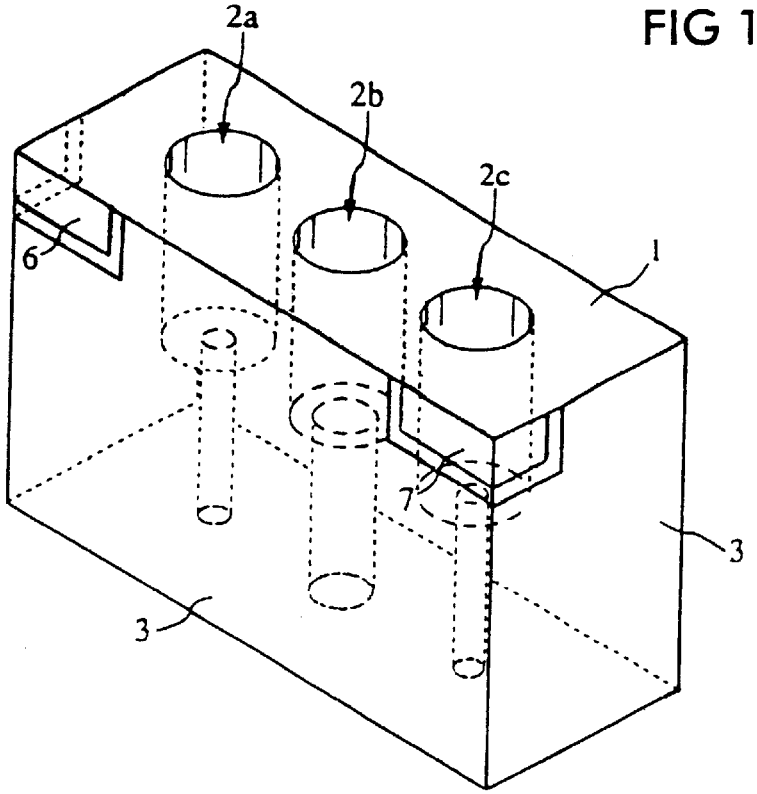
FIG. 1A and FIG. 1B are views showing the structure of a band pass filter according to a first embodiment of the present invention.
Figure 1B:
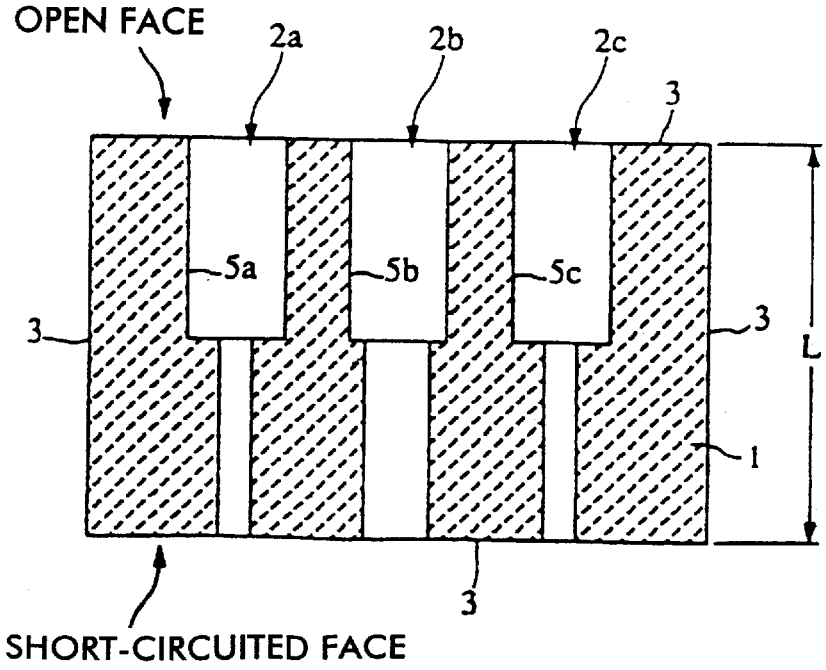

The structure of a band pass filter according to a first embodiment of the present invention will be illustrated by referring to FIGS. 1A and 1B.

FIG. 1A is a perspective view of the band pass filter and FIG. 1B is a vertical-sectional view of the filter shown in FIG. 1A. In this figure, reference numeral 1 denotes a rectangular-parallelepiped dielectric block. Three resonant-line holes 2*a,* 2*b,* and 2*c,* which pass through from an end face of the dielectric block to the other opposing end face thereof, are aligned in such a manner that they are mutually in parallel. On the inner surfaces of the resonant-line holes 2*a,* 2*b,* and 2*c,* resonant lines 5*a,* 5*b,* and 5*c* are disposed. In addition, on the outer surface of the dielectric block 1, that is, on the five surfaces except one opening face of each of the resonant-line holes 2*a,* 2*b,* and 2*c,* an outer conductor 3 is disposed. The open face of the dielectric block 1, where no outer conductor is formed, is the open end of each of the resonant lines 5*a,* 5*b,* and 5*c,* and the short-circuited face opposing the open face is the short-circuited end of each of the resonant lines. On the outer surface of the dielectric block 1, terminal electrodes 6 and 7 are disposed in such a manner that the electrodes are insulated from the outer conductor 3. These terminal electrodes 6 and 7 are coupled by the capacitance generated between the electrodes and the parts in proximity to the open ends of the resonant lines 5*a* and 5*c*.

The resonant-line holes 2*a,* 2*b,* and 2*c* have stepped structures in which the inner diameters of the open-end sides of the resonant lines 5*a,* 5*b,* and 5*c* are larger than the inner diameters of the short-circuited-end sides. In addition, the inner diameters of the open-end sides of the resonant-line holes 2*a,* 2*b,* and 2*c* have equal sizes and those of the short-circuited-end sides thereof are different. In other words, the inner diameters of the short-circuited-end sides of the first-stage and third-stage resonant-line holes 2*a* and 2*c* have the same length, and at the same time, the inner diameter of the short-circuited-end side of the central resonant-line hole 2*b* is larger than the inner diameter of the first-stage and third-stage resonant-line holes 2*a* and 2*c*. This arrangement permits capacitive-coupling between the adjacent resonant lines to be performed.

In the arrangements described above, while the physical length L of the dielectric block 1 at the parts of the resonant-line holes, and the inner diameters and lengths of the large-diameter parts of the resonant-line holes remain fixed, when the resonant frequencies of the resonant lines at the first, second, and third stages are each set to be f1, f2, and f3, a relationship f1=f3<f2 can be obtained.

In addition, since the capacitive coupling between the first-stage and second-stage resonant lines and the capacitive coupling between the second-stage and third-stage resonant lines are equal, attenuation-pole frequencies obtained by their couplings are equal so that signals on the low-frequency side of the pass band can be steeply attenuated. Since the attenuation-pole frequencies vary with the strength of capacitive coupling, the pass band and the attenuation-pole frequency can arbitrarily be determined by setting the inner diameters of the resonant-line holes on the short-circuited-end side and the open-end side.

In the embodiment shown in FIGS. 1A and 1B, the inner diameter of the short-circuited-end side of the second-stage resonant-line hole is larger than the inner diameters of the short-circuited-end sides of the first-stage and third-stage resonant-line holes. However, in contrast, it is possible to determine the strengths of capacitive couplings between the first-stage and the second-stage and between the second-stage and the third-stage by making the inner diameter of the short-circuited-end side of the second-stage resonant-line hole smaller than the inner diameters of the short-circuited-end sides of the first-stage and third-stage resonant-line holes.

Figure 2A:
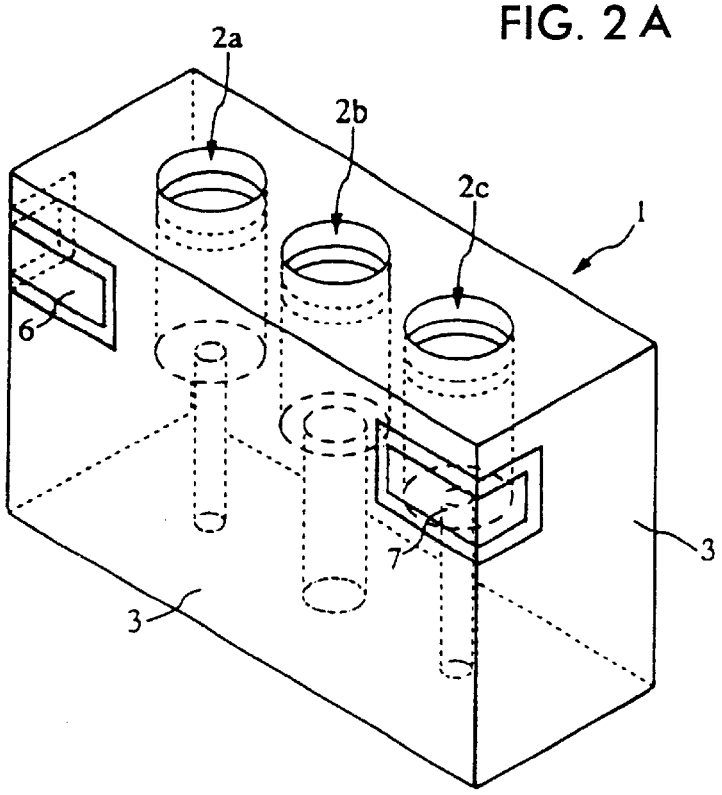
FIG. 2A and FIG. 2B are views showing the structure of a band pass filter according to a second embodiment of the present invention.
Figure 2B:
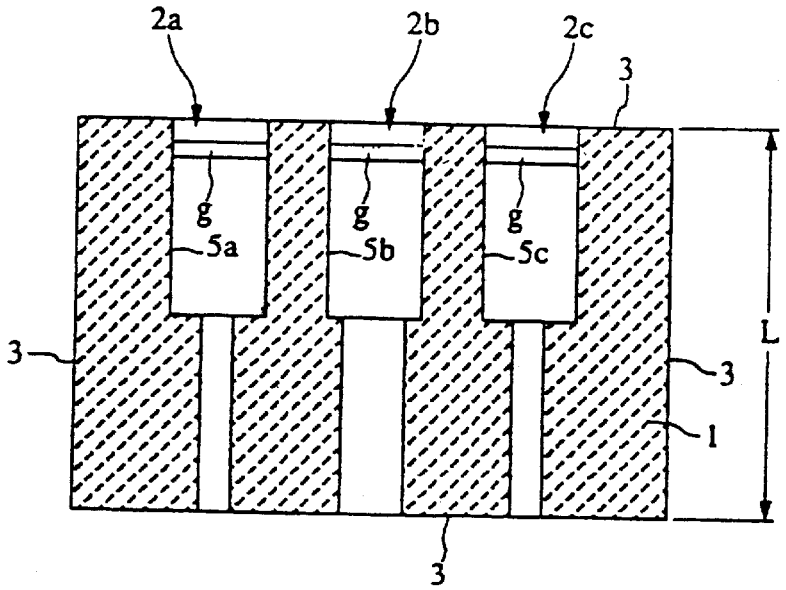

Next, the structure of a band pass filter according to a second embodiment will be illustrated by referring to FIGS. 2A and 2B.

The band pass filter is different from the band pass filter shown in FIGS. 1A and 1B in terms of a point that the open ends of the resonant lines are disposed inside the resonant-line holes. That is, in FIGS. 2A and 2B, reference numeral 1 denotes a substantially rectangular-parallelepiped dielectric block, in which three resonant-line holes 2*a,* 2*b,* and 2*c* passing through from one end face of the dielectric block 1 to the other opposing end face thereof are disposed in such a manner that they are mutually in parallel. An outer conductor 3 is disposed on the six outer surfaces of the dielectric block 1. On the inner surfaces of the resonant-line holes 2*a,* 2*b,* and 2*c,* resonant lines 5*a,* 5*b,* and 5*c,* which are opened at nonconductive portions g near one side openings, are disposed. The surfaces (short-circuited surfaces) opposing the open-end side surfaces are the short-circuited ends of the resonant lines. In addition, on the outer surfaces of the dielectric block 1, terminal electrodes indicated by reference numerals 6 and 7 are disposed by insulating from the outer conductor 3. The terminal electrodes 6 and 7 are coupled by the capacitance generated between the electrodes 6 and 7 and the part in proximity to the open ends of the resonant lines 5*a* and 5*c*.

As in the case of the first embodiment, the resonant-line holes 2*a,* 2*b,* and 2*c* have stepped structures in which the inner diameters on the open-end sides of the resonant lines 5*a,* 5*b,* and 5*c* are larger than the inner diameters on the short-curcuited-end sides thereof, and the inner diameters on the open-end sides of the resonant-line holes 2*a,* 2*b,* and 2*c* have the same size, whereas those on the short-circuited-end sides thereof have different sizes.

As described above, the open end of the resonant line is disposed in a place recessed from the opening face of the resonant-line hole so that an electromagnetic leak can be strongly reduced. Furthermore, since the resonant frequency of each resonant line is determined by changing the inner diameter on the short-circuited-end side of the resonant-line hole, the position and size of the nonconductive portion g can be equal for all the resonant-line holes. As a result, the processing conditions are common and the processing time can thereby be shortened, which leads to reduction in cost.

Figure 3:
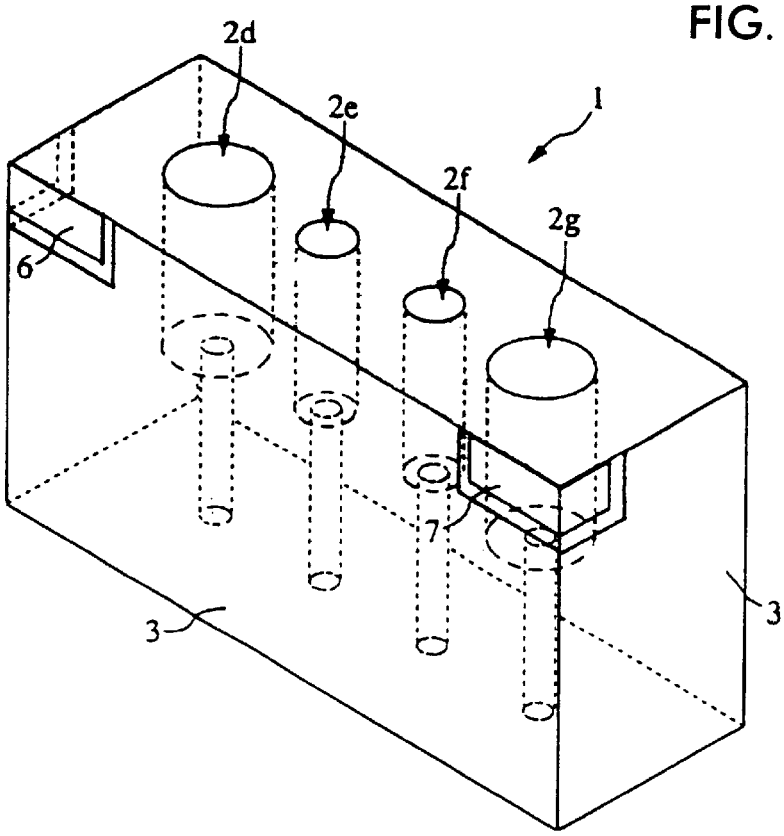
FIG. 3 is a view showing the structure of a band pass filter according to a third embodiment of the present invention.

Next, the structure of a band pass filter according to a third embodiment of the present invention will be illustrated by referring to FIG. 3.

Although the first and second embodiments adopt the example of the band pass filter having a three-stage resonator, the band pass filter according to the third embodiment is constituted of a four-stage resonator. That is, four resonant-line holes 2*d,* 2*e,* 2*f,* and 2*g* passing through from one end face of the dielectric block 1 to the other opposing end face thereof are disposed in such a manner that they are mutually in parallel. One of the outer surfaces of the dielectric block 1 is an open face, and an outer conductor 3 is disposed on the other five surfaces thereof. Resonant lines are formed on the inner surfaces of the resonant-line holes 2*d,* 2*e,* 2*f,* and 2*g*. The surfaces (short-circuited surfaces) opposing the surfaces of the open-end sides are the short-circuited ends of the resonant lines. In addition, terminal electrodes indicated by reference numerals 6 and 7 are disposed on the outer surfaces of the dielectric block 1 by being insulated from the outer conductor 3. These terminal electrodes 6 and 7 are coupled by the capacitance generated between them and the part in proximity to the open ends of the resonant lines on the inner surfaces of the resonant-line holes 2*d* and 2*g*.

In FIG. 3, regarding the resonant-line holes that are in a symmetric relationship with respect to a symmetry axis at the center in a direction where the plural resonant-line holes 2*d,* 2*e,* 2*f,* and 2*g* are aligned, that is, regarding the paired resonant-line holes, which are the pairs of 2*e* and 2*f,* and 2*d* and 2*g,* in order to make the resonant frequencies equal, the inner diameters on the short-curcuited-end sides of the resonant-line holes are fixed and the inner shapes on the open-end side of the resonant-line holes are equal in each of the pairs. In addition, the inner diameters on the open-end sides of the second-stage and third-stage resonant-line holes 2*e* and 2*f* are small to form capacitive-coupling between the resonant lines and to obtain a relationship of f1=f4<f2=f3.

Figure 4:
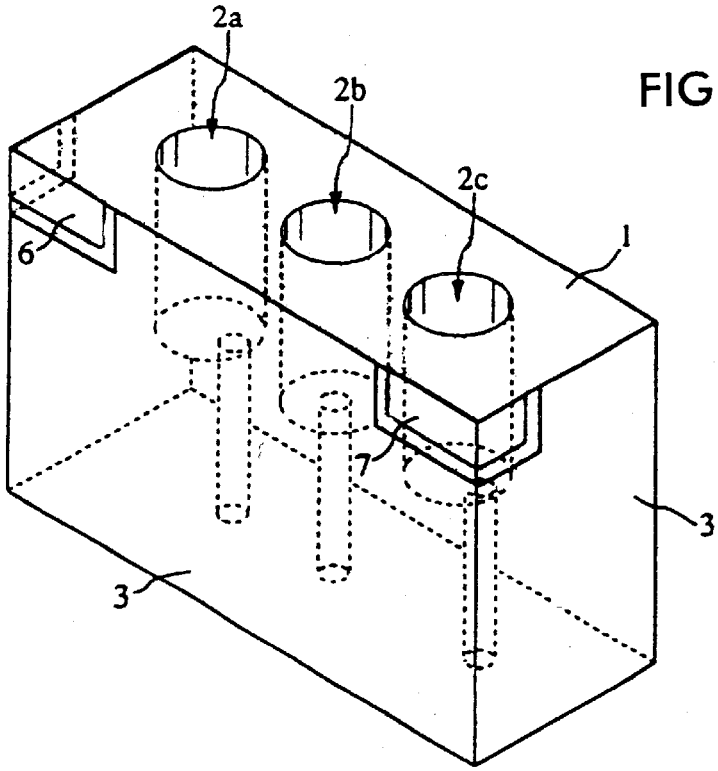
FIG. 4 is a view showing the structure of a band pass filter according to a fourth embodiment of the present invention.

Next, the structure of a pass band filter according to a fourth embodiment will be illustrated by referring to FIG. 4.

FIG. 4 is a perspective view of the pass band filter. In this embodiment, the configurations of the resonant-line holes 2*a,* 2*b,* and 2*c* are different, and the other parts of the structure are the same as those in the filter shown in FIG. 1.

The resonant-line holes 2*a,* 2*b,* and 2*c* have stepped structures in which the inner diameters on the respective open-end sides are larger than the inner diameters on the short-circuited end sides. However, the aligning pitch (the distance between the adjacent resonant-line holes) on the short-circuited-end sides of the resonant-line holes are asymmetric with respect to the central axis obtained by the central resonant-line hole. With this arrangement, the distance on the short-circuited-end sides of the first-stage and second-stage resonant lines is narrowed to form inductive coupling, and the distance on the short-circuited-end sides of the second-stage and third-stage resonant lines is widened to make capacitive coupling.

With this arrangement, the capacitive coupling permits an attenuation pole to be produced on the low-frequency side of the band pass, and the inductive coupling permits an attenuation pole to be produced on the high-frequency side of the pass band.

Furthermore, the aligning pitches of both the short-circuited-end sides and open-end sides of the resonant-line holes can be asymmetric. In addition, it is also possible to make the sizes of the inner diameter of the short-circuited-end sides of the resonant-line holes and the inner diameters on the open-end sides thereof different.

Next, the structure of an antenna duplexer according to a fifth embodiment will be illustrated by referring to FIG. 5.

In FIG. 5, in a rectangular-parallelepiped dielectric block 1, seven resonant-line holes 2*a* to 2*g* passing through from one end face to the other opposing end face are formed. The part indicated by the resonant-line holes 2*a* to 2*c* is substantially equivalent to the structure of the band pass filter constituted of the three-stage resonator shown in FIG. 1, and the part indicated by the resonant-line holes 2*d* to 2*g* is substantially equivalent to the structure of the band pass filter constituted of the four-stage resonator shown in FIG. 3. In order to make an appropriate matching between the part in proximity to the open end of the resonant-line hole 2*c* and a terminal electrode 8, the resonant-line hole 2*c* and the resonant-line hole 2*a* are asymmetric. This creates a difference between the strength of the capacitive coupling between the resonant-line holes 2*a* and 2*b* and the strength of the capacitive coupling between the resonant-line holes 2*b* and 2*c*. Similarly, in order to make an appropriate matching between the part in proximity to the open end of the resonant-line hole 2*d* and the terminal electrode 8, the resonant-line hole 2*d* and the resonant-line hole 2*g* are asymmetric.

In this case, a terminal electrode 6 is used as a Tx terminal, a terminal electrode 7 is used as an Rx terminal, and the terminal electrode 8 is used as an ANT terminal. In addition, the band pass filter constituted of the three-stage resonator indicated by the resonant-line holes 2*a* to 2*c* is used as a transmitting filter, and the band pass filter constituted of the four-stage resonator indicated by the resonant-line holes 2*d* to 2*g* is used as a receiving filter. However, the ANT terminal 8 is used not only as an electrode but a line, and transmitting signals are outputted and receiving signals are inputted at specified parts of the antenna terminal 8.

Although the sectional shapes of the resonant-line holes shown in the above embodiments are circular, it is also possible to make the shapes elliptic or polygonal.

Next, a block diagram showing the structure of a communication apparatus according to a sixth embodiment will be illustrated by referring to FIG. 6.

In FIG. 6, the symbol ANT denotes a transmitting/receiving antenna, the symbol DXP denotes an antenna duplexer, the symbols BPFa, BPFb, and BPFc denote band pass filters, the symbols AMPa and AMPb denote amplifying circuits, the symbols MIXa and MlXb denote mixers, the symbol OSC denotes an oscillator, and the symbol DIV denotes a frequency divider (a synthesizer). MIXa modulates a frequency signal outputted from DIV with a modulating signal, in which BPFa allows only the signals of the transmitting frequency band to pass through, and AMPa power-amplifies the signals, which are transmitted from ANT via DPX. BPFb allows only the signals of the receiving frequency band among the signals outputted from DPX to pass, and AMPb amplifies them. MIXb outputs intermediate frequency signals IF by mixing the frequency signals outputted from BPFc and the receiving signals.

As the DPX portion shown in FIG. 6, an antenna duplexer having the structure shown in FIG. 5 is used. In addition, as the band pass filters BPFa, BPFb, and BPFc, the band pass filters having the structures shown in FIGS. 1 to 4 are used. In this way, an overall compact communication apparatus is formed. While the invention has been particularly shown and described with reference to preferred embodiments thereof, it will be understood by those skilled in the art that the forgoing and other changes in form and details may be made therein without departing from the spirit of the invention.

What is claimed is:

1. A band pass filter comprising three or more resonant-line holes disposed in a dielectric block, a resonant line formed on an inner surface of each of the holes, and an outer conductor disposed on the outer surfaces of the dielectric block so that a dielectric filter is formed;

wherein one end of each resonant line is a short-circuited end, and the other end thereof is an open end;

the sectional area size of each of the resonant-line holes is changed at a certain point in the axial direction of the resonant-line hole;

the sectional area size on the short-circuited-end side or open-end side of at least one of the plurality of resonant-line holes is made different from those of the other resonant-line holes;

and regarding all the resonant-line holes symmetric with respect to a symmetry axis disposed at the center of the dielectric block in a direction in which the plurality of resonant-line holes is aligned, the sectional area sizes of said resonant-line holes at said short-circuited-end side or open-end side thereof are made the same so as to form coupling between adjacent resonant lines.

2. The band pass filter according to claim 1, wherein the sectional area sizes of the short-circuited-end sides or open-end sides of the resonant-line holes are equal for all of the resonant-line holes.

3. The band pass filter according to claim 1, wherein the resonant-line holes have an equal length between the short-circuited ends thereof and the points where the sectional area sizes are changed.

4. The band pass filter according to claim 1, wherein an opening face of each resonant-line hole is an open face devoid of an outer conductor, and the open face is used as the open end of the resonant line.

5. The band pass filter according to claim 1, wherein a nonconductive portion separated from the outer conductor is disposed at a place recessed from the opening face of each resonant-line hole so as to use the nonconductive portion as the open end of the resonant line.

6. An antenna duplexer comprising a pair of band pass filters, each according to claim 1 and providing a transmitting filter and a receiving filter respectively, formed in a single dielectric block, a transmitting-signal input terminal being coupled to an initial-stage resonant line of the transmitting filter, a receiving-signal output terminal being coupled to a final-stage resonant line of the receiving filter, and an antenna terminal being coupled to a final-stage resonant line of the transmitting filter and an initial-stage resonant line of the receiving filter.

7. A communication apparatus comprising the band pass filter according to claim 1, and a high-frequency circuit coupled to said band pass filter.

8. The band pass filter according to claim 2, wherein the resonant-line holes have an equal length between the short-circuited ends thereof and the points where the sectional area sizes are changed.

9. A communication apparatus comprising the antenna duplexer according to claim 6, and a high-frequency circuit coupled to one of said input terminal and said output terminal.

* * * * *